US006869070B2

(12) United States Patent
Shimamura et al.

(10) Patent No.: US 6,869,070 B2
(45) Date of Patent: Mar. 22, 2005

(54) SHEET FEEDING APPARATUS AND IMAGE FORMING APPARATUS AND IMAGE READING APPARATUS PROVIDED WITH SAME

(75) Inventors: Masashi Shimamura, Saitama (JP); Masahiro Shirai, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 207 days.

(21) Appl. No.: 10/370,623

(22) Filed: Feb. 24, 2003

(65) Prior Publication Data

US 2003/0160379 A1 Aug. 28, 2003

(30) Foreign Application Priority Data

Feb. 28, 2002 (JP) ..... 2002-054988
Jun. 10, 2002 (JP) ..... 2002-169134

(51) Int. Cl.[7] ..... B65H 3/52

(52) U.S. Cl. ..... 271/121; 271/109; 271/114; 271/124

(58) Field of Search ..... 271/109, 38, 114, 271/116, 121, 124

(56) References Cited

U.S. PATENT DOCUMENTS 4,887,806 A * 12/1989 Tanaka et al. ..... 271/121
4,995,601 A 2/1991 Ohashi et al. ..... 271/127
5,023,658 A 6/1991 Toyama et al. ..... 355/72
5,205,551 A 4/1993 Nagano et al. ..... 271/225
5,350,168 A * 9/1994 Sheridan ..... 271/122
6,234,470 B1 5/2001 Okitsu et al. ..... 271/114

* cited by examiner

*Primary Examiner*—Donald P. Walsh
*Assistant Examiner*—Kaitlin Joerger
(74) *Attorney, Agent, or Firm*—Fitzpatrick, Cella, Harper & Scinto

(57) ABSTRACT

A sheet feeding apparatus for separating and feeding sheets supported on a sheet supporting portion one by one is provided with a separating and feeding portion having a sheet feed roller provided downstream of the sheet supporting portion for feeding the sheets, and a separation roller brought into pressure contact with the sheet feed roller, and designed to be rotatable in the same direction as or a direction opposite to the rotational direction of the sheet feed roller, and separating and feeding the sheets one by one, and a transport restriction guide provided near the separation roller so as to protrude toward the sheet feed roller for restricting the number of sheets coming into the pressure contact portion between the sheet feed roller and the separation roller, and the transport restriction guide is formed by a flexible member, and is provided so as to be pressed by the sheets coming into between the sheet feed roller and the separation roller and be flexible toward the separation roller side, and the transport restriction guide is flexed so as to abut against the separation roller.

20 Claims, 10 Drawing Sheets

SHEET FEEDING APPARATUS AND IMAGE FORMING APPARATUS AND IMAGE READING APPARATUS PROVIDED WITH SAME

BACKGROUND OF THE INVENTION

1. Field of the Invention

The invention relates to a sheet feeding apparatus and an image forming apparatus and an image reading apparatus provided with the same, and particularly to a construction for separating and transporting sheets one by one.

2. Description of Related Art

In recent years, an image reading apparatus and image forming apparatuses such as a printer, a copying machine, a facsimile apparatus and a compound machine having a plurality of functions are provided with a sheet feeding apparatus for separating and feeding sheets such as originals or recording sheets one by one to an image reading portion or an image forming portion. As such a sheet feeding apparatus, use is widely made of one adopting a retard separation mechanism which can separate sheets highly reliably from a low speed to a high speed.

This retard separation mechanism is designed to separate and feed sheets one by one by a feed roller rotated in a sheet feed direction and a separation roller (retard roller) urged against the feed roller with predetermined pressure and rotated in a direction opposite to the sheet feed direction, in other words, a direction for returning the sheets.

In the drive transmitting path of this separation roller, there is provided a torque limiter for creating slip at a predetermined torque value or greater so that in the absence of a sheet or in a state in which a sheet is being transported between the feed roller and the separation roller, a load comprising a frictional force with the feed roller or the sheet may reach the predetermined torque value or greater of the torque limiter and the torque limiter may slip and the drive may come to be not transmitted, whereby the separation roller may be driven to rotate (be taken to rotate) in the sheet transport direction, whereby a sheet become capable of being reliably transported without being damaged.

Also, in a state in which a plurality of sheets superposed one upon another have come into the pressure contact portion (hereinafter referred to as the nip portion) between the feed roller and the separation roller, the separation roller is designed to be reversely rotated without being driven to rotate, whereby a sheet in contact with the feed roller may be transported in the feed direction by the slip between the sheets, and a sheet in contact with the separation roller may be returned to a sheet supporting portion by the reverse rotation of the separation roller.

To satisfy the transport and separation condition in the above-described construction, it is necessary to satisfy the following expressions:

$$F1>F3>F4>F2 \quad (1)$$

$$F5>F4, \quad (2)$$

where $F1=\mu 1\times N$: the force with which the feed roller advances the sheet $F2=\mu 2\times N$: the force with which the sheets take each other $F3=\mu 3\times N$: the force with which the separation roller stops the sheet $F4=T\div r$: the force with which the separation roller is taken to rotate $F5=\mu 4\times N$: the force with which the feed roller rotates the separation roller $\mu 1$: the coefficient of friction between the feed roller and the sheet $\mu 2$: the coefficient of friction between the sheets $\mu 3$: the coefficient of friction between the separation roller and the sheet $\mu 4$: the coefficient of friction between the feed roller and the separation roller N: the pressure force of the separation roller r: the radius of the separation roller T: idle rotation torque of the torque limiter.

Now, there has heretofore been a retard separation mechanism as shown in FIGS. 7A and 7B of the accompanying drawings wherein in order to secure more reliable separating performance, a separation roller 52 is constituted by an elastic member and near the separation roller 52, there is provided a transport restriction guide 54 adapted to be relatively protruded toward a feed roller 51 by the deformation of the elastic member.

This transport restriction guide 54 is formed so that as it approaches the nip portion between the feed roller 51 and the separation roller 52, the interval between it and the feed roller 51 may become narrower. Also, this transport restriction guide 54 is formed by a flexible member and the surface thereof adjacent to the feed roller is formed with a rugged shape abutting against the feed roller 51.

By thus constituting the separation roller 52 by an elastic member, and providing the transport restriction guide 54 adapted to be relatively protruded toward the feed roller 51, even if a sheet stack comprising a number of sheets superposed one upon another comes into the nip portion, a portion of the sheet stack having come in which is adjacent to the separation roller can be received by the rugged shape of the transport restriction guide 54 without hindering the operation of the separation roller, as shown in FIG. 7B, whereby only a few sheets separable can be made to come into the roller nip portion.

Also, even from a state in which the leading edge of a plurality of sheets having come in is caught by the rugged shape of the transport restriction guide 54, as the number of sheets is decreased by the separating operation, the separation roller 52 comprising an elastic member pushes out the sheets and therefore, the bad feeding of the sheets can be avoided.

As another sheet separation mechanism, there is a separation pad mechanism provided with a feed roller rotated in a sheet feed direction, and a frictional pad urged against the feed roller with predetermined pressure, and separating and feeding sheets one by one.

However, in a sheet feeding apparatus adopting such a retard roller mechanism, in the case of a vertical type sheet feeding mechanism designed such that for example, a sheet is inclined and is made to come into the nip with the aid of the gravity of the sheet, a sheet having a high coefficient of friction, coupled with the gravity of the sheet S, cannot sometimes be received by the transport restriction guide 54 and a plurality of sheets may come into the nip like a sheet.

When such a situation happens, F2 (the force with which the sheets take each other) mentioned above becomes high and exceeds F4 (the force with which the separation roller is taken to rotate) and the separation roller 52 is taken to rotate by the sheet stack, and the sheet stack having come into the nip is intactly double-fed.

SUMMARY OF THE INVENTION

So, the present invention has been made in view of such present situation and has as its object to provide a sheet feeding apparatus which can reliably separate and feed sheets one by one, and an image forming apparatus and an image reading apparatus provided with the same.

According to the present invention, a sheet feeding apparatus for separating and feeding sheets supported on a sheet supporting portion one by one is provided with a separating and feeding portion having sheet feeding means provided downstream of the sheet supporting portion for feeding the sheets, and separating means brought into pressure contact with the sheet feeding means and designed to be rotatable in the same direction as or a direction opposite to the rotational direction of the sheet feeding means, and separating and feeding the sheets one by one, and a transport restriction guide provided near the separating means so as to protrude toward the sheet feeding means for restricting the number of sheets coming into the pressure contact portion between the sheet feeding means and the separating means, and the transport restriction guide is formed by a flexible member, and is provides so as to be pressed by the sheets coming into between the sheet feeding means and the separating means and be flexible toward the separating means side, and the transport restriction guide is flexed so as to abut against the separating means.

Also, a torque limiter is provided on drive transmitting means for transmitting drive to the separating means, and when a load applied from the sheet feeding means or the sheet being fed to the separating means reaches a predetermined value or greater, the transmission of the drive is interrupted by the torque limiter and a separation roller is provided so as to be capable of being taken to rotate by the sheet feeding means or the sheet being fed, and when the separation roller is capable of being taken to rotate by the torque limiter, the transport restriction guide may abut against the separating means to thereby restrict the separation roller from being taken to rotate.

Also, the separating means may be formed by an elastic member, and the transport restriction guide may be designed to be relatively protruded to the sheet feeding means side by the elastic deformation of the separating means.

Also, design may be made such that a force for regulating the rotation of the separating roller in the same direction as the rotational direction of the sheet feeding means is increased in conformity with the amount of flexure of the transport restriction guide.

Also, provision may be made of an engagement portion for bringing the separating means and the transport restriction guide into engagement with each other when the transport restriction guide is flexed.

Also, a one-way clutch may be provided at a position whereat the separating means abuts against the transport restriction guide when the transport restriction guide is flexed, and the rotation of the separating roller in the same direction as the rotational direction of the sheet feeding means may be regulated through the one-way clutch.

Also, the image forming apparatus of the present invention is provided with an image forming portion and the above-described sheet feeding apparatus for feeding sheets to the image forming portion.

Also, the image reading apparatus of the present invention is provided with an image reading portion and the above-described sheet feeding apparatus for feeding sheets to the image reading portion.

As described above, according to the present invention, the transport restriction guide for restricting the number of sheets coming into the pressure contact portion between the sheet feeding means and the separating means is formed by a flexible member so that the transport restriction guide may be pressed by the sheets coming into the pressure contact portion and be flexed to the separating means side and abut against the separating means, whereby even if a plurality of sheets superposed one upon another like a sheet come into the pressure contact portion, the sheets can be reliably separated and fed one by one.

DESCRIPTION OF THE PREFERRED EMBODIMENTS

Some embodiments of the present invention will hereinafter be described with reference to the drawings.

Figure 2A:
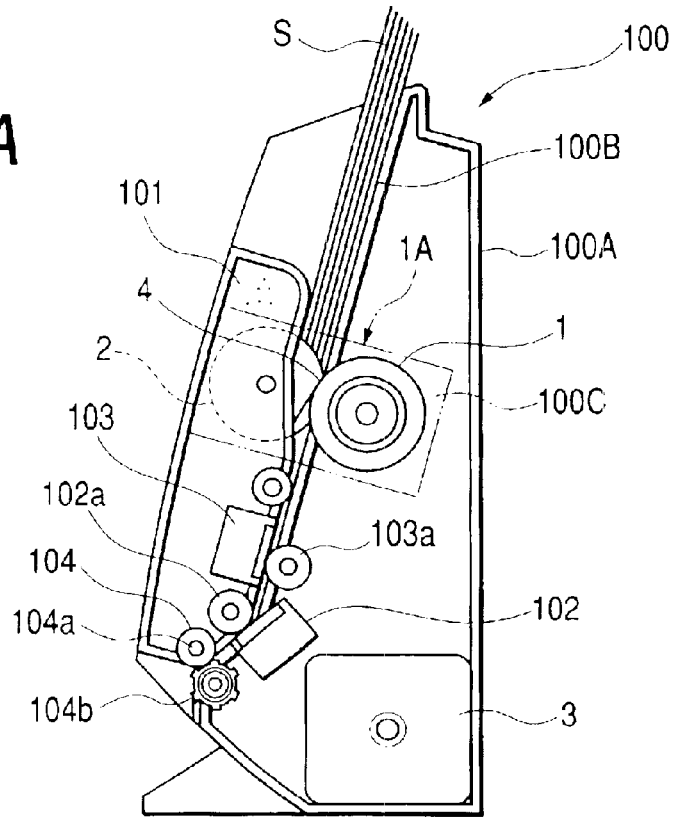
FIGS. 2A and 2B illustrate the construction of the image reading apparatus.
Figure 2B:
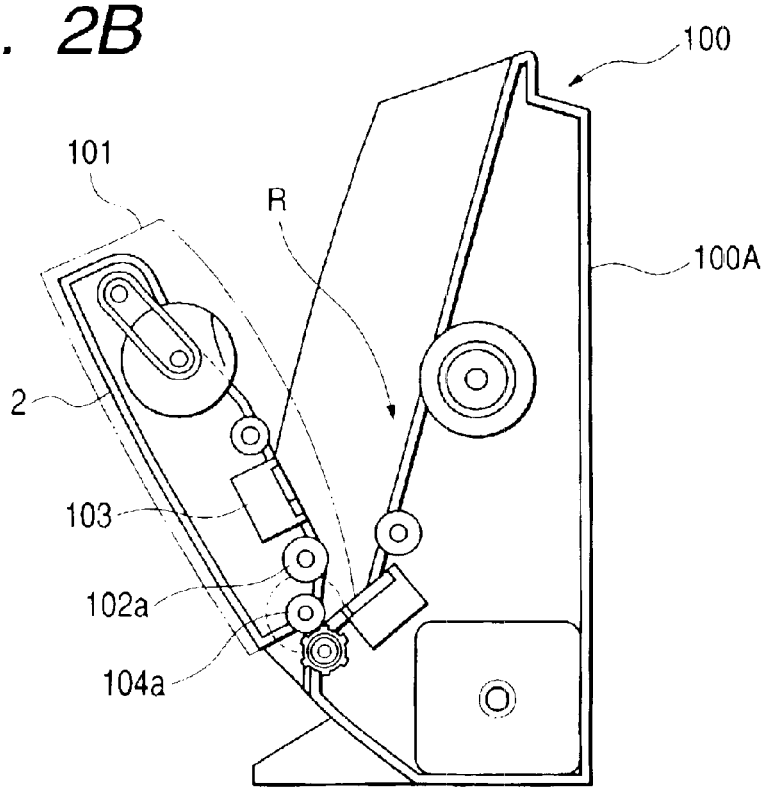

FIGS. 2A and 2B show the construction of an image reading apparatus according to a first embodiment of the present invention.

In FIGS. 2A and 2B, the reference numeral 100 designates the image reading apparatus, the reference character 100A denotes the main body of the image reading apparatus, the reference character 100B designates a sheet stacking portion which is a sheet supporting portion stacking and supporting thereon sheets S in their inclined state, the reference numerals 102 and 103 denote front side and back side image reading portions for reading images on the sheets S, and the reference character 100C designates a sheet feeding apparatus for feeding the sheets S supported on the sheet stacking portion 100B to the front side and back side image reading portions 102 and 103.

The sheet feeding apparatus 100C is provided with a separating and feeding portion 1A comprised of a feed roller 1 which is sheet feeding means, and a separation roller 2 which is separating means brought into pressure contact with the feed roller 1, and for separating the sheets S stacked on the sheet stacking portion 100B one by one. A main motor 3 rotatively drives the feed roller 1 in a sheet transport direction and rotatively drives the separation roller 2 formed by an elastic member.

Description will now be made of the image reading operation in the image reading apparatus 100 constructed as described above.

When the image reading operation is started, the plurality of sheets S stacked on the sheet stacking portion 100B are separated one by one by the feed roller 1 and the separation roller 2 brought into pressure contact with each other. Thereafter, the sheet is passed while being in close contact with the front side and back side image reading portions 102 and 103 by platen rollers 102*a* and 103*a*.

An image formed on the front side or the back side of the sheet S is line-scanned by passing while facing the front side and back side image reading portions 102 and 103, and is outputted as an electrical signal to the outside. Also, after the reading of the image has been done as described above, the sheet S is delivered to the outside by a pair of delivery rollers 104 (a pair of delivery rollers 104*a* and 104*b*).

In FIGS. 2A and 2B, an upper unit 101 constitutes the main body of the sheet feeding apparatus provided with the separation roller 2, the back side image reading portion 103, the upper delivery roller 104*a*, etc. The upper unit 101 is usually closed as shown in FIG. 2A, but for example, in case of jam clearance, the cleaning of the rollers and maintenance, it is adapted to be upwardly opened with a sheet transport path R as the boundary, as shown in FIG. 2B. By being thus opened, it is designed to be capable of spacing the separation roller 2 apart from the feed roller 1.

Figure 1:
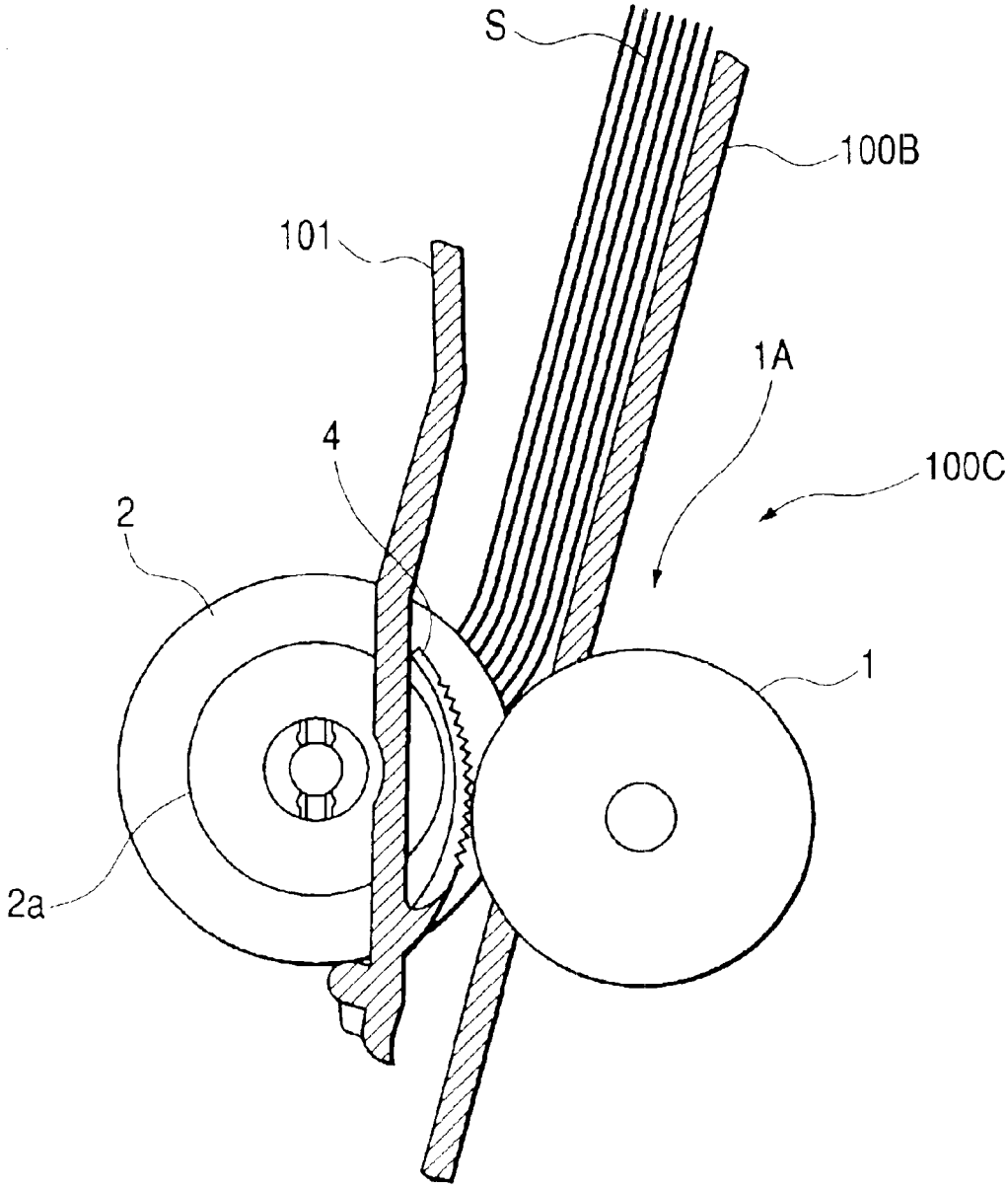
FIG. 1 shows the construction of a sheet feeding apparatus provided in an image reading apparatus according to a first embodiment of the present invention.

Referring now to FIG. 1 which illustrates the construction of the sheet feeding apparatus 100C, the reference character 2*a* designates the shaft portion of the separation roller 2. The separation roller 2 is provided with a torque limiter (not shown) in the drive transmitting route thereof, and in the absence of the sheets S or in a state in which a sheet is being transported between the feed roller 1 and the separation roller 2, a load received by the separation roller 2 from the feed roller 1 or a sheet becomes greater than the torque value when the torque limiter slips and therefore, drive is not transmitted to the separation roller 2, and the separation roller 2 is adapted to be driven to rotate (taken to rotate) in a sheet transport direction.

Also, in a state in which a plurality of sheets S superposed one upon another have come into the nip portion between the rollers 1 and 2, the separation roller 2 is adapted to be not driven to rotate but to be reversely rotated, whereby the sheet S in contact with the feed roller 1 is transported in a feed direction by the slip between the sheets, and the sheet in contact with the separation roller 2 is returned to the sheet stacking portion 100B by the separation roller 2 being reversely rotated.

Figure 3:
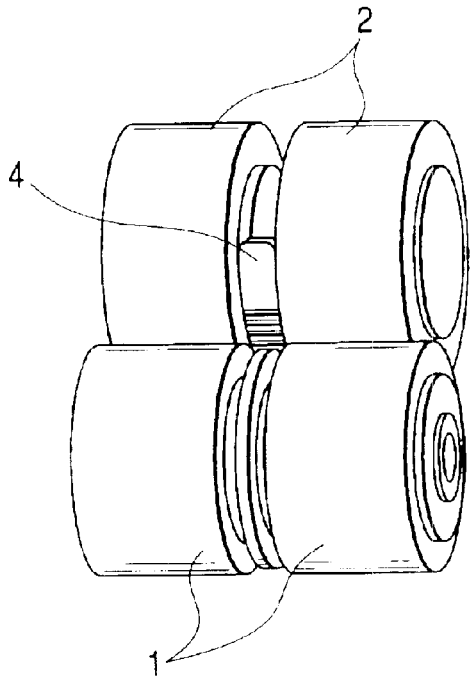
FIG. 3 is a perspective view of the essential portions of the separating and feeding portion of the sheet feeding apparatus.

Also, in the present embodiment of FIG. 1, design is made such that sheets S superposed one upon another more than a prescribed number are prevented from coming into the nip portion between the feed roller 1 and the separation roller 2 by a transport restriction guide 4. In the present embodiment, this transport restriction guide 4 is provided between two separation rollers 2, as shown in FIG. 3.

Figure 4A:
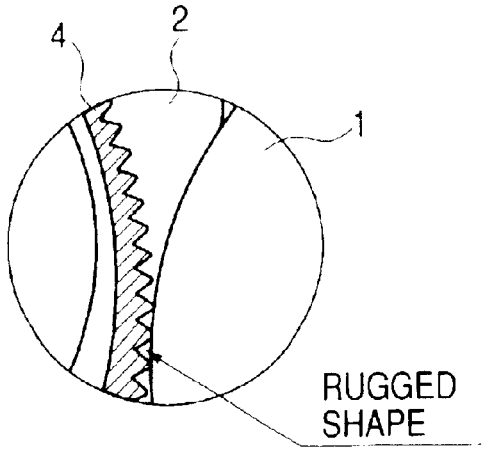
FIGS. 4A and 4B are enlarged views of the essential portions of the separating and feeding portion of the sheet feeding apparatus.

The transport restriction guide 4 is located inside the outer periphery of the separation roller 2, and the surface thereof facing the feed roller 1 is ruggedly formed as shown in FIG. 4A. As described above, the separation roller 2 is constituted by an elastic member and the transport restriction guide 4 is provided, whereby a sheet stack comprising a number of sheets superposed one upon another comes into the nip portion, a part of the sheets having come in which is adjacent to the separation roller can be received by the rugged shape of the transport restriction guide 4 without the operation of the separation roller being hindered, and thus, only a few separable sheets can be made to come into the nip portion.

Figure 4B:
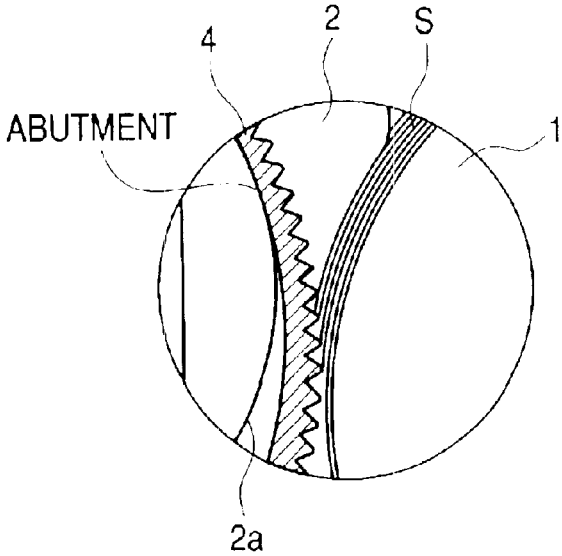

Now, the transport restriction guide 4 is formed by a flexible member, whereby if the number of sheets S coming into the nip portion becomes great, the transport restriction guide 4 is pressed by the feed roller 1 with the sheets interposed therebetween and comes into pressure contact with the shaft portion 2*a* of the separation roller 2 with a great force, as shown in FIG. 4B.

When the transport restriction guide 4 thus abuts against the shaft portion 2*a* of the separation roller 2, the rotational torque value at which the separation roller 2 is taken to rotate (the torque value when the separation roller changes from its reversely rotated state to the state in which it is taken to rotate) gradually becomes high due to the friction between the transport restriction guide 4 and the shaft portion 2*a* of the separation roller 2, and it becomes difficult for the separation roller 2 to be taken to rotate. That is, even if the torque limiter slips by the load the separation roller 2 receives from the sheets S having come into the nip portion and the separation roller 2 becomes capable of being taken to rotate, the separation roller 2 is not taken to rotate due to the frictional force between the transport restriction guide 4 and the shaft portion 2*a* of the separation roller 2, and it never happens that the sheets are fed out in the form of a stack.

Thereby, the rotation of the separation roller 2 is hindered even if, for example, a plurality of sheets S having a high coefficient of friction come into the nip portion in a superposed state like a sheet, coupled with the gravity of the sheets S. As a result, it never happens that the force (F2) with which the sheets take each other exceeds a torque value (F4) at which the separation roller 2 begins to be taken to rotate, and the sheets S can be reliably handled one by one and transported to an image processing portion.

As described above, the transport restriction guide 4 is formed by a flexible member, and is pressed by the sheets S coming into the nip portion and is flexed toward the separation roller side so as to abut against the shaft portion 2*a* of the separation roller 2, whereby even if a plurality of sheets S having a high coefficient of friction cannot be well received by the transport restriction guide 4, but come into the nip portion like a sheet, the rotation of the separation roller 2 can be stopped. Also, as the number of sheets S coming into the nip portion becomes greater, the force with which the transport restriction guide 4 abuts against the shaft portion 2*a* of the separation roller 2 becomes greater and it becomes difficult for the separation roller to be taken to rotate and therefore, it never happens that the sheets are fed out in the form of a stack, and reliable separation of the sheets can be accomplished.

Thereby, the entry of the sheet in contact with the separation roller side can be prevented, and even if a plurality of sheets having a high coefficient of friction are set, the sheets can be reliably separated and transported one by one. As a result, a situation in which sheet treatment is stagnated by double feed or the like can be eliminated, and there can be provided a sheet feeding apparatus of high reliability.

Figure 5:
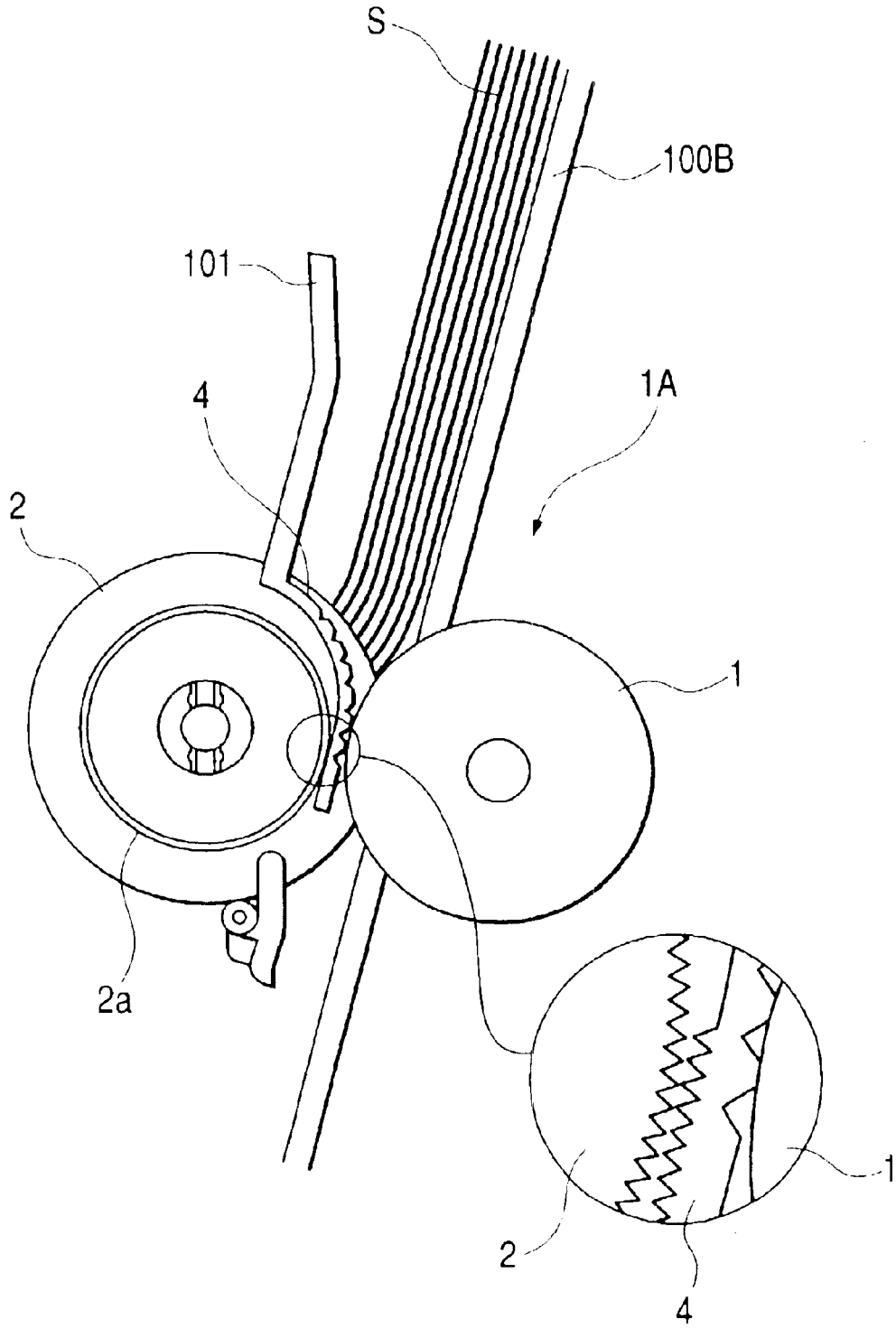
FIG. 5 illustrates the construction of a sheet feeding apparatus according to a second embodiment of the present invention.

As shown, for example, in FIG. 5, engagement portions of such a shape that they are engaged with each other are formed on that portion of the shaft portion 2*a* of the separation roller 2 which is abutted against by the transport restriction guide 4, whereby even during the entry of a plurality of sheets, the transport restriction guide 4 is flexed and the abutment portion is engaged and as a result, the separation roller 2 can be reliably prevented from being taken to rotate, and it becomes possible to prevent the double feed of sheet stacks.

Figure 6:
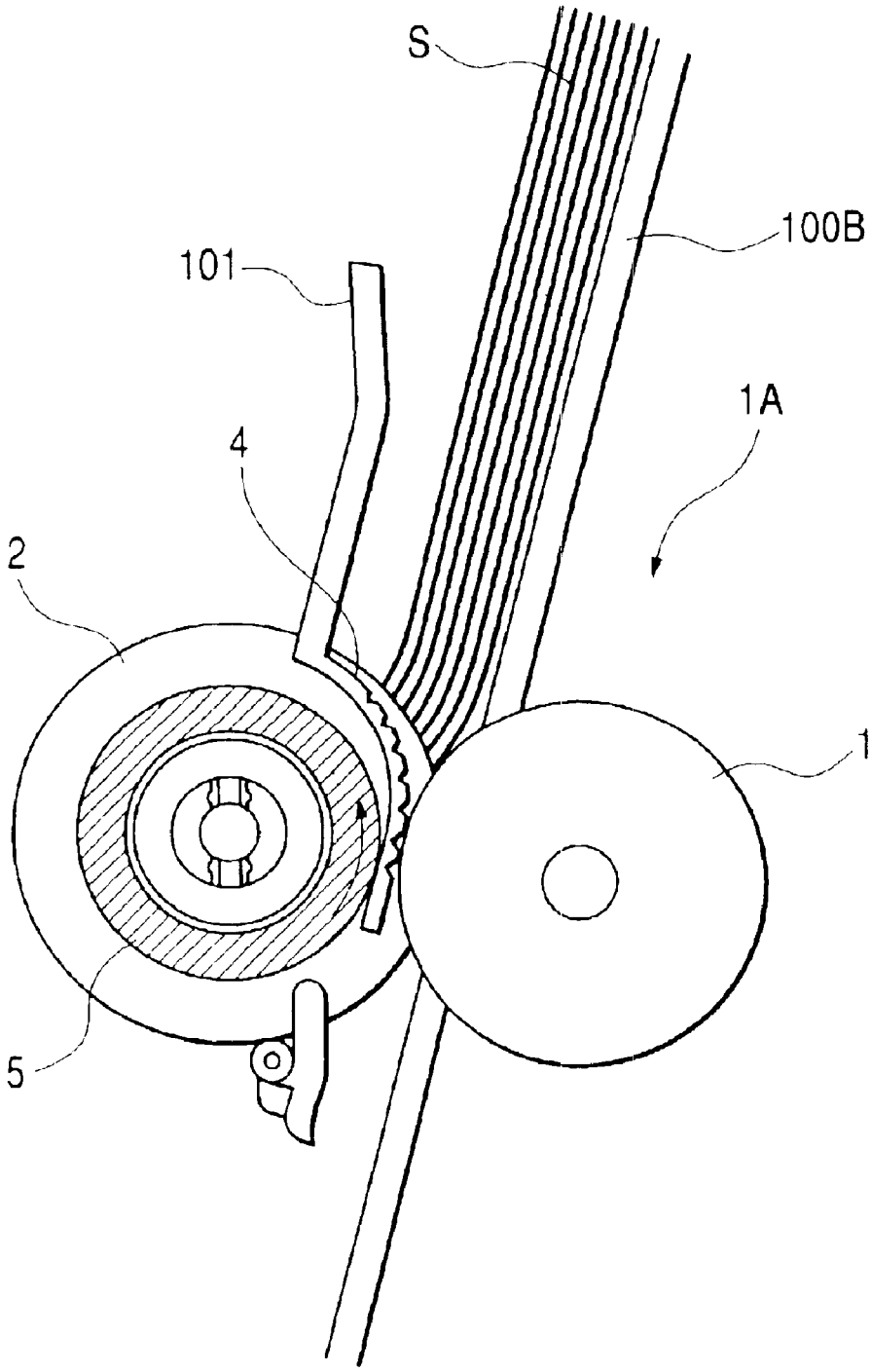
FIG. 6 illustrates the construction of a sheet feeding apparatus according to a third embodiment of the present invention.
Figure 7A:
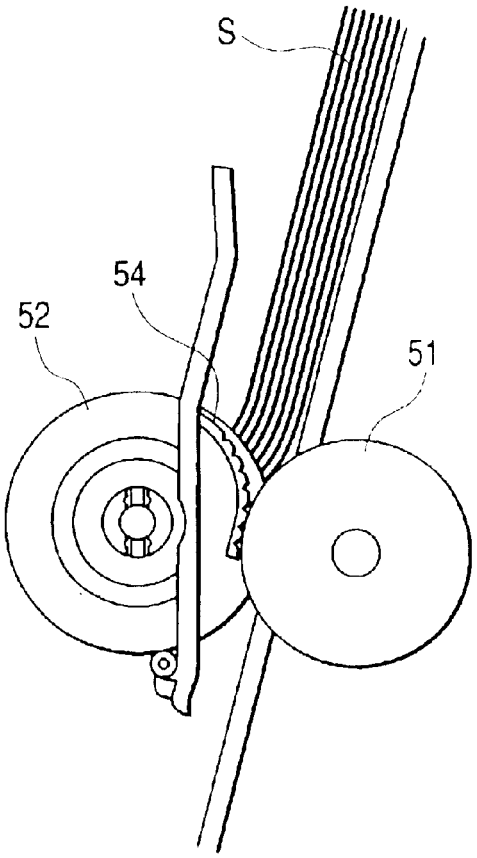
FIGS. 7A and 7B illustrate the construction of a sheet feeding apparatus according to the conventional art.
Figure 7B:
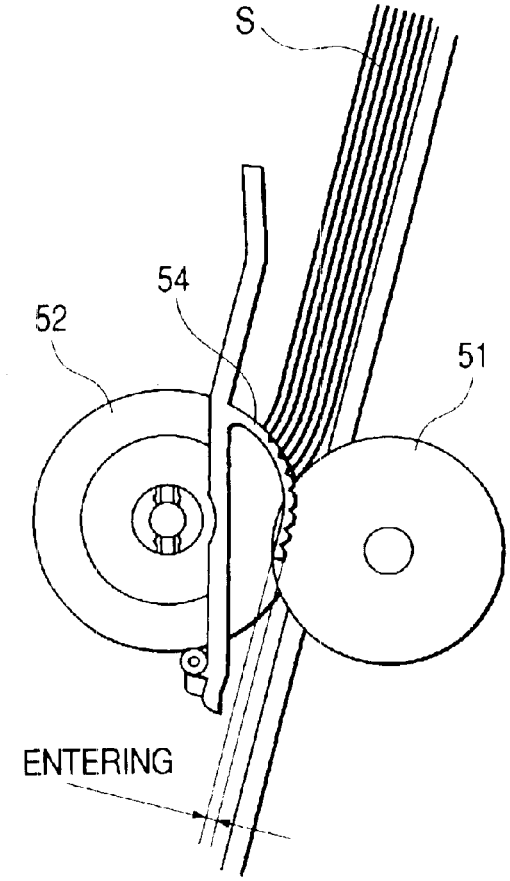

Also, as shown in FIG. 6, a one-way clutch 5 is provided coaxially with the separation roller 2 and at a location whereat the transport restriction guide 4 abuts, whereby even during the entry of a plurality of sheets, the transport restriction guide 4 is flexed and abuts against the one-way clutch 5 and as a result, the torque by which the separation roller 2 is taken to rotate changes to a high value, and it becomes possible to prevent the double feed of sheet stacks. This one-way clutch 5 is designed to be free to rotate in the return direction of the separation roller 2 irrespective of the abutment of the transport restriction guide 4 and therefore, separating performance can be sufficiently secured.

While in the above-described embodiment, design is made such that the transport restriction guide 4 abuts against the shaft portion 2*a* of the separation roller 2 to thereby change the rotational torque, in the present invention, the location against which the transport restriction guide 4 is not restricted to the shaft portion 2*a*, but for example, a cylindrical member may be fixed coaxially with the separation roller 2 so that the transport restriction guide 4 may abut against it. That is, there may be adopted any construction in which the transport restriction guide 4 is pushed by the sheets and abuts against a member on the separation roller side so that the rotational torque of the separation roller 2 can be changed.

Also, while description has hitherto been made with an image reading apparatus taken as an example, the sheet feeding apparatus according to the present invention can of course be also applied to an image forming apparatus provided with an image forming portion and designed such that sheets are fed to this image forming portion by the sheet feeding apparatus.

Another construction of the reading portion will now be described with reference to FIGS. 8 to 11.

This construction of the reading portion is applicable to rollers 1, 2, 103*a*, 102*a*, 104, etc. and reading portions 102 and 103 similar in action to those in the embodiment of FIGS. 1 to 6.

This construction is directed to providing an original transporting apparatus adapted to be capable of easily pulling out an original which has been read without widening the interval between originals, and to enabling a jammed original to be easily taken out of the discharge port of the apparatus without the original and the apparatus being damaged even in case of the jam clearance of the original.

That is, it has as its object to provide a compact image reading apparatus in which the allowable errors of the dimensions of the outer diameters of rollers which are a pair of rotary members can be increased to thereby reduce the manufacturing cost of the rollers and at the same originals can be stably transported even when a rotational peripheral speed difference has occurred between a pair of upstream transport rollers which are a pair of upstream rotary members and a pair of downstream transport rollers which are a pair of downstream rotary members.

An original transporting apparatus according to an embodiment and an image reading apparatus provided with this original transporting apparatus in the main body of the apparatus will hereinafter be described with reference to the drawings.

Figure 8:
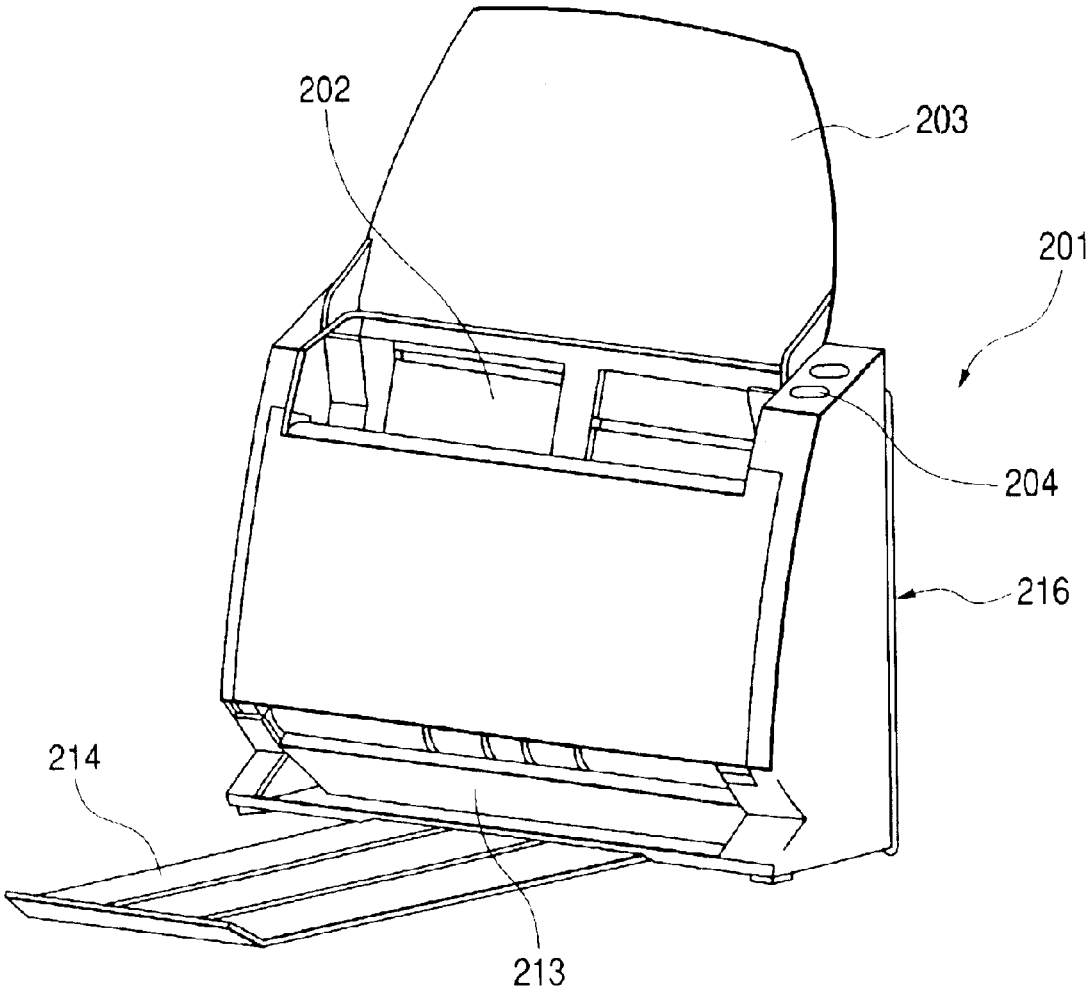
FIG. 8 is a pictorial perspective view showing another embodiment of the image reading apparatus of the present invention in detail.
Figure 9:
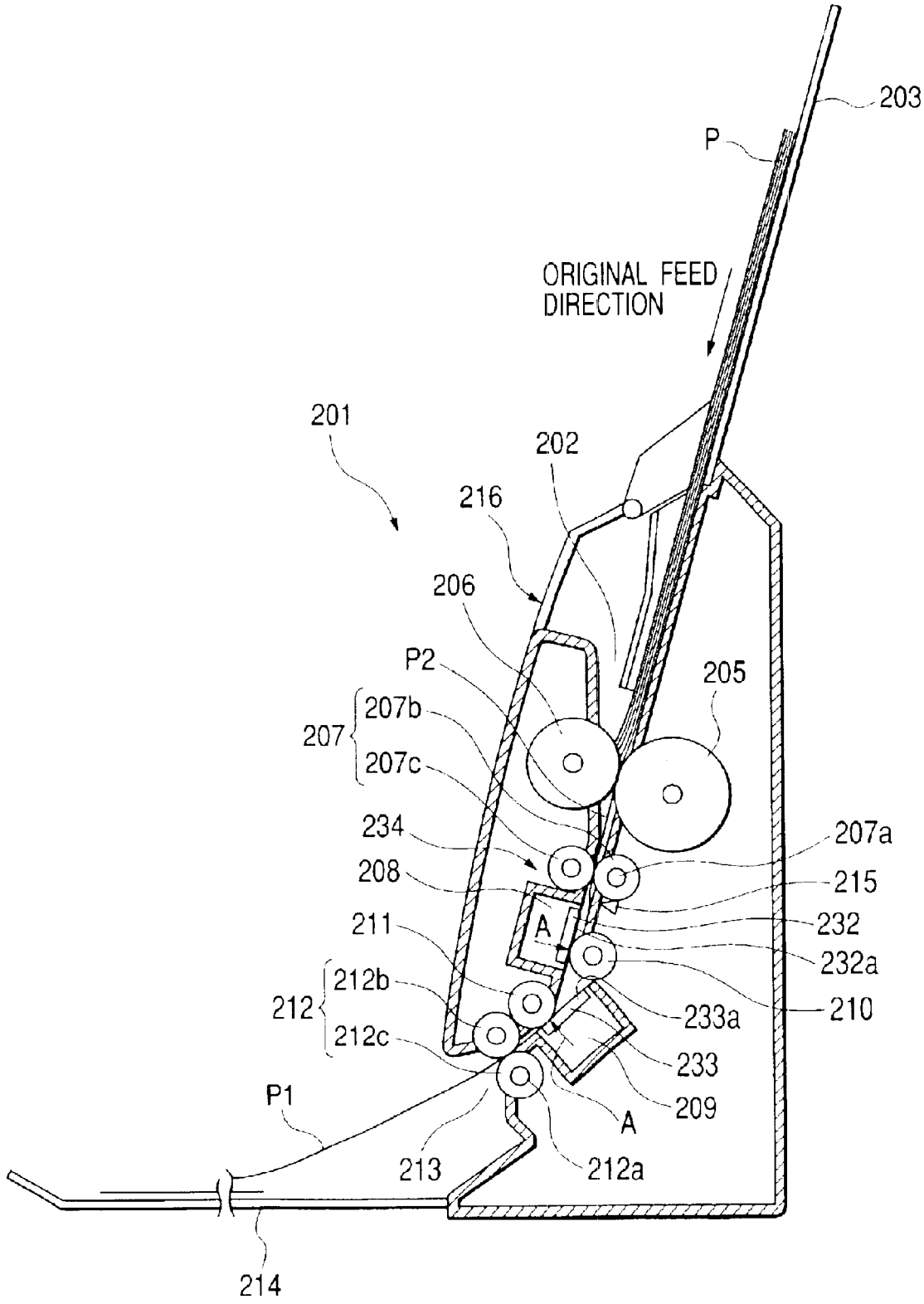
FIG. 9 is a schematic cross-sectional view of the image reading apparatus shown in FIG. 8 provided with an original transporting apparatus in the main body of the apparatus as it is broken away along an original transport direction.

FIG. 8 is a pictorial perspective view of the image reading apparatus according to the present embodiment. FIG. 9 is a schematic cross-sectional view of the image reading apparatus of FIG. 8 provided with the original transporting apparatus in the main body of the apparatus as it is broken away along an original transport direction.

As shown in FIGS. 8 and 9, an original supply tray 203 is disposed at an angle approximate to verticality above the original supply port 202 of the image reading apparatus 201. Originals P are set on the original supply tray 203 with their front surfaces facing downward, by a user. When the start button 204 of an operating portion is depressed and a reading start command is outputted, an original feed roller 205 and a retard roller 206 begin to be rotated by an original transporting motor 218 shown in FIGS. 10 and 11. The original feed roller 205 is given the rotational force of the original transporting motor 218 in a direction to pull the originals P into the main body 216 of the apparatus. The retard roller 206 is given the rotational force of the original transporting motor 218 in a direction to push back the originals P with predetermined torque by a torque limiter shown in FIG. 11 which is connected to the retard roller 206.

When an original P comes into the nip between the original feed roller 205 and the retard roller 206, the retard roller 206 is taken to rotate with the original P. Therefore, the original P is fed to a pair of upstream transport rollers 207 by the rotational force of the original feed roller 205. However, when a plurality of originals P come into the nip between the original feed roller 205 and the retard roller 206 at a time, the retard roller 206 is rotated in a direction opposite to the transport direction of the originals P to thereby push back the second and subsequent originals P which are not in contact with the original feed roller 205 to the original supply tray 203.

When only the first original P comes into the nip, the retard roller 206 starts to be taken to rotate in timed relationship with the transport of that original P. In this manner, the originals P are separated one by one by the retard separation by the retard roller 206 and are fed to the pair of upstream transport rollers 207.

Figure 10:
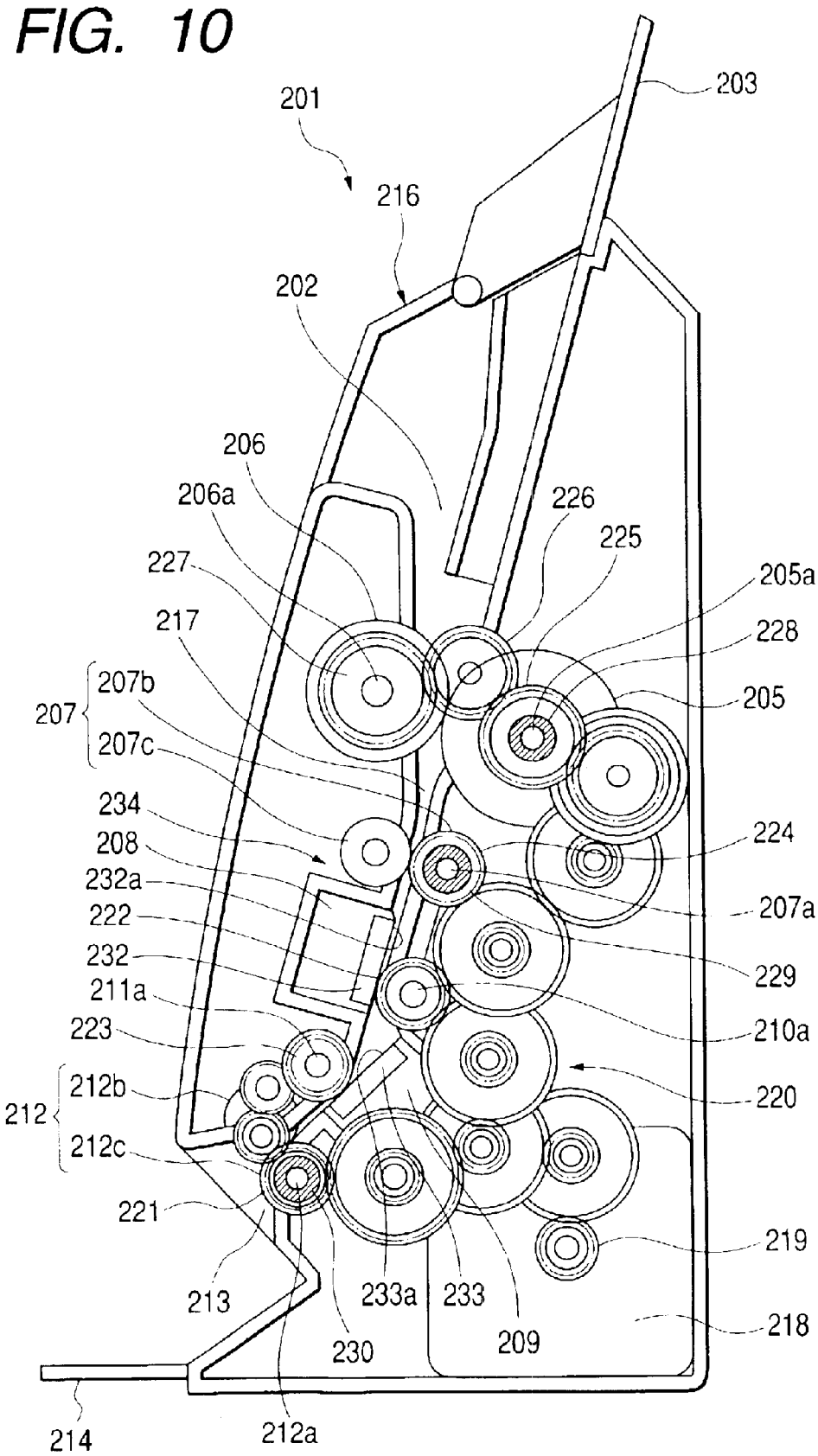
FIG. 10 shows a driving system for original transport in an original transporting apparatus incorporated as a constituent of the image reading apparatus according to the embodiment of FIG. 8 in the main body thereof.
Figure 11:
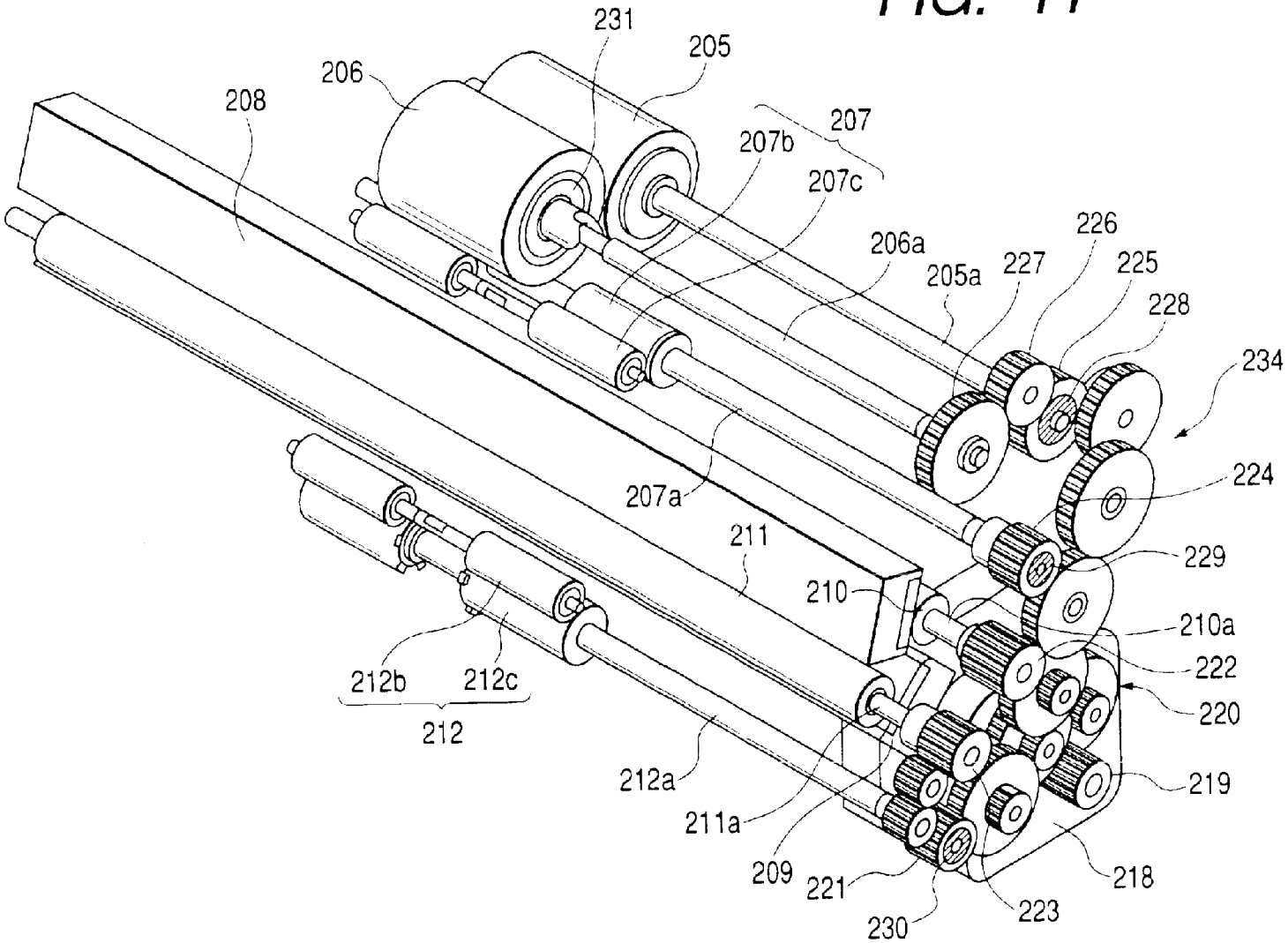
FIG. 11 is a perspective view of the essential portions of the driving system shown in FIG. 10.

The pair of upstream transport rollers (a pair of upstream rotary members) 207 have a driving roller (driving rotary member) 207b rotated by the original transporting motor 218 shown in FIGS. 10 and 11, and a driven roller (driven rotary member) 207*c* driven to rotate with the rotation of the driving roller 207*b* while directly contacting with the driving roller 207*b* or while contacting with the driving roller 207*b* with the original interposed therebetween.

The original P is transported to an upstream contact type image sensor 208 at a predetermined speed by the pair of upstream transport rollers 207. In the image reading apparatus 201 according to the present embodiment, in order to read images formed on both sides of the original, a pair of contact type image sensors 208 and 209 which are image reading means are disposed on the opposite sides of an original transport path 217 so that the reading surfaces 232*a* and 233*a* of the contact type image sensors 208 and 209, respectively, may be opposed to the original transport path 217. In such an arrangement, the upstream contact type image sensor 208 first reads the image on the back side of the original P. Subsequently, the downstream contact type image sensor 209 reads the image on the front side of the original P.

Platen rollers 210 and 211 are installed on the sides opposed to the reading positions A of the contact type image sensors 208 and 209 in proximity thereto. The platen rollers 210 and 211 are disposed so that the outer peripheral surfaces thereof may keep a predetermined interval with respect to the reading surfaces (surfaces of contact glass plates 232, 233) 232*a* and 233*a* of the contact type image sensors 208 and 209, respectively, without directly contacting therewith. The reason why this interval is kept is for preventing the surfaces of the contact glass plates 232, 233 from being stained or injured, and for preventing an increase in the rotational loads of the platen rollers 210 and 211 by the contact friction between the platen rollers 210, 211 and the contact glass 232, 233.

In the case of an image reading apparatus of a type which reads only one side of an original, there can be provided only a contact type image sensor opposed to an image to be read. Accordingly, the contact type image sensors need not always be provided in a pair.

In the image reading apparatus 201 according to the present embodiment, in order to make the apparatus compact by bending the original transport path 217, the downstream contact type image sensor 209 is disposed at a position whereat the reading surface 233*a* thereof is inclined by a predetermined angle with respect to the original transport direction. The leading edge portion of the original P which has passed the reading position A of the downstream contact type image sensor 209 has its transport direction changed over along the outer peripheral surface of the platen roller 211 and is transported to a pair of downstream transport rollers 212.

The pair of downstream transport rollers (a pair of downstream rotary members) 212 have a driving roller (driving rotary member) 212*b* rotated by the original transporting motor 218 shown in FIGS. 10 and 11, and a driven roller (driven rotary member) 212*c* driven to rotate with the rotation of the driving roller 212*b* while directly contacting with the driving roller 212*b* or while contacting with the driving roller 212*b* with the original interposed therebetween.

The original P is delivered to an original delivery tray 214 disposed below the delivery port 213 of the image reading apparatus 201, by a pair of downstream transport rollers 212 which are a pair of delivery rollers provided at the original delivery end of the original transport path 217. The second and subsequent originals P are also delivered to the original delivery tray 214 in the same manner. The originals P are stacked on the original delivery tray 214 in the same order as that when they were set on the original supply tray 203.

FIG. 10 shows the original transport driving system of an original transporting apparatus 234 incorporated as a constituent element of the image reading apparatus 201 into the main body 216 of the image reading apparatus 201 according to the present embodiment. FIG. 11 is a perspective view of the essential portions of the driving system of the original transporting apparatus 234 shown in FIG. 10. As shown in FIGS. 10 and 11, the motor gear 219 of the original transporting motor 218 is connected, by a gear train 220, to a driving gear 221 fixed to the roller shaft 212*a* of the driving roller 212*b* of the pair of downstream transport rollers 212, driving gears 222 and 223 fixed to the shafts 210*a* and 211*a*, respectively, of the platen rollers 210 and 211, a driving gear 224 fixed to the roller shaft 207*a* of the driving roller 207*b* of the pair of upstream transport rollers 207, and a driving gear 225 fixed to the roller shaft 205*a* of the original feed roller 205, so as to transmit the rotational force of the original transporting motor 218 to the rollers 212*b*, 210, 211 and 207*b*. A belt may be used instead of the gear train 220.

The rotational force of the driving gear 225 fixed to the roller shaft 205*a* of the original feed roller 205 is further transmitted to the shaft 206*a* by a gear 26 and a driving gear 27 fixed to the shaft 206*a* of the retard roller 206. As a result, the retard roller 206 is rotated through the torque limiter 231 mounted in the interior of the retard roller 206.

Also, in order to create an interval (inter-original interval) between originals, the rotational peripheral speed of the original feed roller 205 is set to a speed lower than the rotational peripheral speed of the pair of upstream transport rollers 207, the platen rollers 210, 211 and the pair of downstream transport rollers 212. However, the driving gear 225 of the original feed roller 205 is connected to the roller shaft 205*a* through a one-way clutch 228 and therefore, the original feed roller 205 is taken to rotate with the original P from after the leading edge portion of the original P has arrived at the pair of upstream transport rollers 207 until the trailing edge portion of the original P leaves the original feed roller 205.

In the case of a page scan mode, at a point of time whereat the trailing edge of the first original P1 has passed the reading position A of the downstream contact type image sensor 209 (see FIG. 9), the transport of the original is once stopped before the leading edge of the next original P2 arrives at the reading position A of the upstream contact type image sensor 208, that is, on the basis of a detection signal obtained by the leading edge of the next original P2 being detected by an original passage detecting sensor 215.

Accordingly, the length of the inter-original interval need be at least such a degree of length that at a point of time whereat the trailing edge of the first original P1 has passed the reading position A of the downstream contact type image sensor 209, the leading edge of the next original P2 does not arrive at the reading position A of the upstream contact type image sensor 208. In the case of the page scan mode, as in the example of the conventional art, the transport of the original is stopped with the trailing edge of the original P1 which has been read nipped between the pair of downstream transport rollers 212.

The first original P1 which has been read may be intactly delivered without being once stopped, but since in order to achieve the downsizing and reduced cost of the image reading apparatus 201, the rollers 212*b*, 210, 211 and 207*b* are designed to be rotated by a single original transporting motor 218, the rollers must be stopped at a time, and as a result, the rotation of the pair of downstream transport rollers 212 must also be stopped, and the transport of the original is stopped with the first original P1 which has been read being nipped between the pair of the downstream transport rollers 212. If design is made such that the first original P1 is delivered in such a manner that only the pair of downstream transport rollers 212 can continue to be rotated, a motor exclusively for the pair of downstream transport rollers 212, clutch means for the changeover of drive, etc. must be discretely provided, and this leads to the bulkiness and increased cost of the image reading apparatus, and this is not preferable.

In the original transporting apparatus 234 according to the present embodiment, the driving gear 224 of the pair of upstream transport rollers 207 is connected to the roller shaft 207*a* through a one-way clutch 229. Likewise, the driving gear 221 of the pair of downstream transport rollers 212 is connected to the roller shaft 212*a* through a one-way clutch 230. Thereby, the pair of upstream transport rollers 207 are rotatively driven in the original transport direction, but the roller shaft 207*a* of the pair of upstream transport rollers 207 is idly rotatable in the original transport direction. Likewise, the pair of downstream transport rollers 212 are rotatively driven in the original transport direction, but the roller shaft 212*a* of the pair of downstream transport rollers 212 is idly rotatable in the original transport direction.

Accordingly, even if reading is completed and an original stopped with its trailing edge nipped between the pair of downstream transport rollers 212 is drawn out of the delivery port 213, it will never happen that an unreasonable load occurs to the original and the driving system and the gears which constitute the driving system, the gear train 220 and the original transporting motor 218 are taken to rotate and the standby position of the next original deviates.

If the one-way clutch 230 is not provided, when the original stopped with its trailing edge nipped between the pair of downstream transport rollers 212 is drawn out of the delivery port 213, the pair of downstream transport rollers 212 are rotated and by the rotation thereof, the roller shaft 212*a*, the gears which constitute the driving system, the gear train 220 and the original transporting motor 218 are taken to rotate to thereby rotate the pair of upstream transport rollers 207, which thus feed an original and thus, the standby position of the original deviates and deviation occurs to the image reading start position.

This also holds true when a jammed original stopped at a position between the pair of upstream transport rollers 207 and the pair of downstream transport rollers 212 is drawn out of the delivery port 213 and removed.

When the original is not stopped at the position between the pair of upstream transport rollers 207 and the pair of downstream transport rollers 212, but is stopped while being nipped between only the pair of downstream transport rollers 212, it is not necessary to provide the one-way clutch 229 for the pair of upstream transport rollers 207, but the one-way clutch 230 may be provided only for the pair of downstream transport rollers 212.

Now, the pair of upstream transport rollers 207 and the pair of downstream transport rollers 212 in the original transporting apparatus 234 according to the present embodiment are made to have the same outer diameter and the gear ratios of the respective driving gears 224 and 221 are made the same so that the transport speeds of the originals may become substantially the same, but due to the tolerance of the outer diameter of the rollers in the manufacture thereof, a difference sometimes occurs between the transport speeds of the originals.

For example, when the speed of the pair of downstream transport rollers 212 becomes higher than the speed of the pair of upstream transport rollers 207, the pulling of the original usually occurs between the rollers. However, the roller shaft 207*a* is idly rotated by the one-way clutch 229 connected to the driving gear 224 of the pair of upstream transport rollers 207 and the speed difference is absorbed. As a result, it never happens that a load by the pulling of the original occurs to the gears which constitute the driving system, the gear train 220 and the original transporting motor 218. Also, the fluctuation of the load of the driving system when the trailing edge of the original leaves the pair of upstream transport rollers 207 can be alleviated.

When conversely, the speed of the pair of downstream transport rollers 212 becomes lower than the speed of the pair of upstream transport rollers 207, and particularly when the original is a thick and rigid original, the rotational speed difference between the pair of downstream transport rollers 212 becomes resistance when the leading edge of the original has come into the nip between the pair of downstream transport rollers 212, and the shock or the load to the original and the driving system is increased. However, the roller shaft 212*a* is idly rotated with the driving roller 212*b* by the one-way clutch 230 connected to the driving gear 221 of the pair of downstream transport rollers 212, and the pair of downstream transport rollers 212 are taken to rotate at the original transport speed by the pair of upstream transport rollers 207 and therefore, the shock or the load to the original and the driving system can be absorbed.

Also, in the case of a thin and less rigid original, a loop (the flexure of the original) may occur between the pair of upstream transport rollers 207 and the pair of downstream transport rollers 212. However, the platen rollers 210 and 211 which are original regulating means are disposed on the side opposed to the reading position A of the contact type image sensors 208 and 209 and therefore, it never happens that a read image is deteriorated.

In the above-described construction, the original transporting apparatus 234 is constituted by the pair of upstream transport rollers (the pair of upstream rotary members) 207, the pair of downstream transport rollers (the pair of downstream rotary members) 212, the gears 221, 222, 223, 224 and 225 which constitute the driving system, the gear train 220, the original transporting motor 218, the one-way clutch (upstream one-way rotational force transmitting means) 229, the one-way clutch (downstream one-way rotational force transmitting means) 230, etc.

In the image reading apparatus 201 according to the present embodiment, the platen rollers 210 and 211 are rotated at the same rotational peripheral speed as that of the pair of upstream transport rollers 207 and the pair of downstream transport rollers 212, but the outer peripheral surfaces thereof are not directly in contact with the reading surfaces of the contact type image sensors 208 and 209 (the surfaces of the contact glass plates 232, 233), but are held while keeping a predetermined interval therebetween and thus, they give only an auxiliary transporting force to the original.

Also, not only the platen rollers, but pressure plates as original regulating means may be brought into contact with the surface opposed to the reading positions A of the contact type image sensors 208 and 209, with a minute pressure force.

Also, while in the original transporting apparatus 234 according to the present embodiment, the one-way clutches 229 and 230 are provided integrally with the driving gears 224 and 221, respectively, connected to the roller shafts 207*a* and 208*a* of the pair of upstream transport rollers 207 and the pair of downstream transport rollers 212, they may be provided between the driving rollers 207*b*, 212*b* and the roller shafts 207*a*, 208*a*.

The original transporting apparatus 234 according to the present embodiment can easily draw out an original which has been read, by the above-described construction, without widening the interval between originals.

The original transporting apparatus 234 according to the present embodiment can reduce the pulling of the original between the pair of upstream transport rollers 207 and the pair of downstream transport rollers 212, the resistance when the original plunges into between the pair of downstream transport rollers 212, and the fluctuation of a load given to the driving system when the original leaves the pair of upstream transport rollers 207, even if the rotational peripheral speeds of the driving rollers 207*b* and 212*b* differ from each other under the influence of the tolerance of the outer diameters of the driving rollers 207*b* and 212*b* in the pair of upstream transport rollers 207 and the pair of downstream transport rollers 212 and a difference occurs between the transport speeds of the originals.

Since the image reading apparatus 201 is provided with the original transporting apparatus 234 which can easily draw out an original which has been read, in the main body 216 of the apparatus, a jammed original can be easily taken out of the delivery port 213 of the main body 216 of the apparatus without the original and the apparatus being injured.

Also, by the pair of downstream transport rollers 212 being provided at the original delivery end of the original transport path 217, the image reading apparatus can be made compact and at the same time, the occurrence of a load can be reduced when the original is drawn out with respect to the transport direction of the original.

What is claimed is:

1. A sheet feeding apparatus for separating and feeding sheets supported on a sheet supporting portion one by one, comprising:

a separating and feeding portion for separating and feeding the sheets one by one, said separating and feeding portion having sheet feeding means provided downstream of the sheet supporting portion for feeding the sheets, and separating means brought into pressure contact with the sheet feeding means and rotatable in the same direction as or a direction opposite to a rotational direction of the sheet feeding means; and a transport restriction guide provided in a vicinity of the separating means so as to protrude toward the sheet feeding means for restricting a number of sheets coming into a pressure contact portion between the sheet feeding means and the separating means, wherein the transport restriction guide is formed by a flexible member, and is provided so as to be pressed by the sheets coming into between the sheet feeding means and the separating means and be flexible toward the separating means side, and the transport restriction guide is flexed so as to abut against the separating means.

2. A sheet feeding apparatus according to claim 1, wherein a torque limiter is provided on drive transmitting means for transmitting a drive force to the separating means, and when a load exerted by the sheet feeding means or the sheet being fed on the separating means reaches a predetermined value or greater, a transmission of the drive force is interrupted by the torque limiter and a separation roller is rotatable in association with the sheet feeding means or the sheet being fed, and when the separation roller is associatively rotatable through the torque limiter, the transport restriction guide abuts against the separating means to thereby restrict an associative rotation of the separation roller.

3. A sheet feeding apparatus according to claim 1 or 2, wherein the separating means is formed by an elastic member, and the transport restriction guide is provided between two separating means and is relatively protruded toward the sheet feeding means by an elastic deformation of the separating means.

4. A sheet feeding apparatus according to claim 1 or 2, wherein a force for regulating a rotation of the separating roller in the same direction as the rotational direction of the sheet feeding means is increased in accordance with an amount of flexure of the transport restriction guide.

5. A sheet feeding apparatus according to claim 1 or 2, further comprising an engagement portion for bringing the separating means and the transport restriction guide into engagement with each other when the transport restriction guide is flexed.

6. A sheet feeding apparatus according to claim 2, wherein a one-way clutch is provided in a position in which the separating means abuts against the transport restriction guide when the transport restriction guide is flexed, and a rotation of the separating means in the same direction as the rotational direction of the sheet feeding means is regulated through the one-way clutch.

7. An image forming apparatus comprising:

an image forming portion; and a sheet feeding apparatus according to claim 1 or 2 for feeding sheets to the image forming portion.

8. An image reading apparatus comprising:

an image reading portion; and a sheet feeding apparatus according to claim 1 or 2 for feeding sheets to the image reading portion.

9. An original transporting apparatus for separating and feeding originals supported on a sheet supporting portion one by one, comprising:

a separating and feeding portion for separating and feeding the originals one by one, said separating and feeding portion having original feeding means provided downstream of the sheet supporting portion for feeding the originals, and separating means brought into pressure contact with the original feeding means and rotatable in the same direction as or a direction opposite to the rotational direction of the original feeding means; and a transport restriction guide provided in a vicinity of the separating means so as to protrude toward the original feeding means for restricting a number of originals coming into a pressure contact portion between the original feeding means and the separating means, wherein the transport restriction guide is formed by a flexible member, and is provided so as to be pressed by the originals coming into between the original feeding means and the separating means and flexible toward the separating means side, and the transport restriction guide is flexed so as to abut against the separating means.

10. An original transporting apparatus according to claim 9, further comprising:

a pair of upstream rotary members having a driving rotary member and a driven rotary member rotated by rotation of the driving rotary member for feeding a separated original to original reading means for reading the original;

a pair of downstream rotary members having a driving rotary member and a driven rotary member rotated by rotation of the driving rotary member for transporting the original from the original reading means; and downstream one-way rotational force transmitting means provided between a drive source for rotating the driving rotary member of the pair of downstream rotary members and the driving rotary member for the transmitting a rotational force of the drive source in a direction to transport the original to the driving rotary member, and permitting the rotation of the driving rotary member by the rotational force when the rotational force in the direction to transport the original is applied to the driving rotary member.

11. An original transporting apparatus according to claim 10, further comprising upstream one-way rotational force transmitting means provided between a drive source for rotating the driving rotary member of the pair of upstream rotary members and the driving rotary member for transmitting a rotational force of the drive source in the direction to transport the original to the driving rotary member, and permitting the rotation of the driving rotary member by the rotational force when the rotational force in the direction to transport the original is applied to the driving rotary member.

12. An original transporting apparatus according to claim 10 or 11, wherein the drive source of the pair of upstream rotary members and the drive source of the pair of downstream rotary members are a common drive source.

13. An original transporting apparatus according to claim 10 or 11, wherein the driving rotary member of the pair of upstream rotary members and the driving rotary member of the pair of downstream rotary members are rollers having an identical size in diameter.

14. An original transporting apparatus according to claim 10, wherein a torque limiter is provided on drive transmitting means for transmitting a drive force to the separating means, and when a load exerted by the original feeding means or the original being fed on the separating means reaches a predetermined value or greater, the transmission of the drive force is interrupted by the torque limiter and a separation roller is rotatable in association with the original feeding means or the original being fed, and when the separation roller is associatively rotatable through the torque limiter, an associative rotation of the separation roller is regulated by the abutment of the transport restriction guide against the separating means.

15. An original transporting apparatus according to claim 10, wherein a rotational peripheral speed of the original feeding means is set to a speed lower than a rotational peripheral speed of the pair of upstream rotary members and a rotational peripheral speed of the pair of downstream rotary members.

16. An original transporting apparatus according to claim 10, wherein the original reading means is provided with an upstream contact type image sensor and a downstream contact type image sensor, and at a point of time whereat a trailing edge of a first original has passed a reading position of the downstream contact type image sensor, the transport of the original is once stopped before a leading edge of a next original arrives at a reading position of the upstream contact type image sensor, that is, on the basis of a detection signal obtained by the leading edge of the next original being detected by an original passage detecting sensor.

17. An original transporting apparatus according to claim 16, wherein it is in a case of a page scan mode that the transport of the original is once stopped.

18. A sheet feeding apparatus for separating and feeding sheets supported on a sheet supporting table one by one, comprising:

a separating and feeding portion for separating and feeding the sheets one by one, said separating and feeding portion having a sheet feeding rotary member provided downstream of the sheet supporting table for feeding the sheets, and a separating rotary member brought into pressure contact with the sheet feeding rotary member and rotatable in the same direction as or a direction opposite to the rotational direction of the sheet feeding rotary member; and a transport restriction guide provided in a vicinity of the separating rotary member so as to protrude toward the sheet feeding rotary member for restricting a number of sheets coming into a pressure contact portion between the sheet feeding rotary member and the separating rotary member, wherein the transport restriction guide is formed by a flexible member, and is provided so as to be pressed by the sheets coming into between the sheet feeding rotary member and the separating rotary member and be flexible toward the separating rotary member side, and the transport restriction guide is flexed so as to abut against the separating rotary member.

19. A sheet feeding apparatus according to claim 18, wherein the separating rotary member is formed by an elastic member, and the transport restriction guide is provided between two separating rotary members in an axial direction of the two separating rotary members, and is relatively protruded toward the sheet feeding rotary member side by an elastic deformation of the separating rotary member by the pressure contact thereof with the sheet feeding rotary member.

20. A sheet feeding apparatus according to claim 18, wherein the transport restriction guide is provided with a rugged portion for bringing the separating rotary member and the transport restriction guide into engagement with each other when the transport restriction guide is flexed.

* * * * *

UNITED STATES PATENT AND TRADEMARK OFFICE

CERTIFICATE OF CORRECTION

PATENT NO. : 6,869,070 B2
DATED : March 22, 2005
INVENTOR(S) : Masashi Shimamura et al.

It is certified that error appears in the above-identified patent and that said Letters Patent is hereby corrected as shown below:

Title page,
Item [73], Assignee, "Canon Kabushiki Kaisha, Tokyo (JP)" should read -- Canon Denshi Kabushiki Kaisha, Chichibu (JP --.
Item [57], ABSTRACT,
Line 16, "into" should be deleted.

Column 10,
Line 27, "need" should read -- needs to --.

Column 13,
Line 33, "into" should be deleted.

Column 14,
Line 33, "into" should be deleted.

Column 16,
Line 23, "into" should be deleted.

Signed and Sealed this

Twenty-seventh Day of September, 2005

JON W. DUDAS
*Director of the United States Patent and Trademark Office*

UNITED STATES PATENT AND TRADEMARK OFFICE

CERTIFICATE OF CORRECTION

PATENT NO. : 6,869,070 B2
APPLICATION NO. : 10/370623
DATED : March 22, 2005
INVENTOR(S) : Masashi Shimamura et al.

It is certified that error appears in the above-identified patent and that said Letters Patent is hereby corrected as shown below:

TITLE PAGE AT ITEM [73]:
Assignee: "Canon Kabushiki Kaisha, Tokyo (JP)" should read --Canon Denshi Kabushiki Kaisha, Chichibu (JP)--.

Signed and Sealed this

Sixth Day of March, 2007

JON W. DUDAS
*Director of the United States Patent and Trademark Office*